US007861355B2

(12) United States Patent
Farnworth et al.

(10) Patent No.: US 7,861,355 B2
(45) Date of Patent: Jan. 4, 2011

(54) RETRACTABLE ERASER WITH BRISTLES

(75) Inventors: Stuart David Farnworth, Westport, CT (US); Jonathan A. Lee, Milford, CT (US); Lee Webb, West Haven, CT (US)

(73) Assignee: Acme United Corporation, Fairfield, CT (US)

( * ) Notice: Subject to any disclaimer, the term of this patent is extended or adjusted under 35 U.S.C. 154(b) by 660 days.

(21) Appl. No.: 11/899,545

(22) Filed: Sep. 6, 2007

(65) Prior Publication Data

US 2009/0064453 A1 Mar. 12, 2009

(51) Int. Cl.
*B43L 19/00* (2006.01)

(52) U.S. Cl. ..... 15/105.52; 15/433

(58) Field of Classification Search ..... 15/433, 15/105.52

See application file for complete search history.

(56) References Cited

U.S. PATENT DOCUMENTS 2,207,296 A * 7/1940 Lee ..... 15/433
5,592,711 A * 1/1997 Maier et al. ..... 15/106

* cited by examiner

*Primary Examiner*—Shay L Karls
(74) *Attorney, Agent, or Firm*—Alix, Yale & Ristas, LLP

(57) ABSTRACT

A retractable eraser has an elongated contoured housing which has a longitudinal slot and spaced detents and an opening at one end. A carrier has a button which is depressible so that a catch clears the detents to permit selective longitudinal displacement of the carrier. An oval shaped eraser element is mounted to the carrier and displaced into and out of the housing so as, in one position, to project beyond the housing. Bristles project longitudinally from the housing around the opening.

12 Claims, 2 Drawing Sheets

RETRACTABLE ERASER WITH BRISTLES

BACKGROUND

This application relates to erasers which are retractable into a housing. More particularly, this application relates to erasers which are thumb actuated for projection out of and retraction into a housing.

SUMMARY OF THE DISCLOSURE

An eraser for erasing pencil marks and the like comprises an elongated contoured housing which defines a longitudinal slot with longitudinally spaced detents along the slot. The housing has an opening at one end. A carrier is disposed in the housing and has a thumb actuated button with a catch which is receivable in the detents. The button is depressible so that the catch clears detents to permit longitudinal displacement of the carrier with respect to the housing. An eraser is mounted to the carrier and is displaceable with the carrier so that in one position, the eraser is retained within the housing. In a second position, the eraser extends through the opening to project beyond the housing. Bristles project generally longitudinally from the housing.

The eraser typically has an elongated shape with a generally elliptical cross-section. An array of bristle groups generally surrounds the opening. The carrier has an integral leaf which biases the button so that a catch normally engages in a detent. The interior of the housing is traversed by channels for supporting the eraser and the carrier.

DETAILED DESCRIPTION

Figure 1:
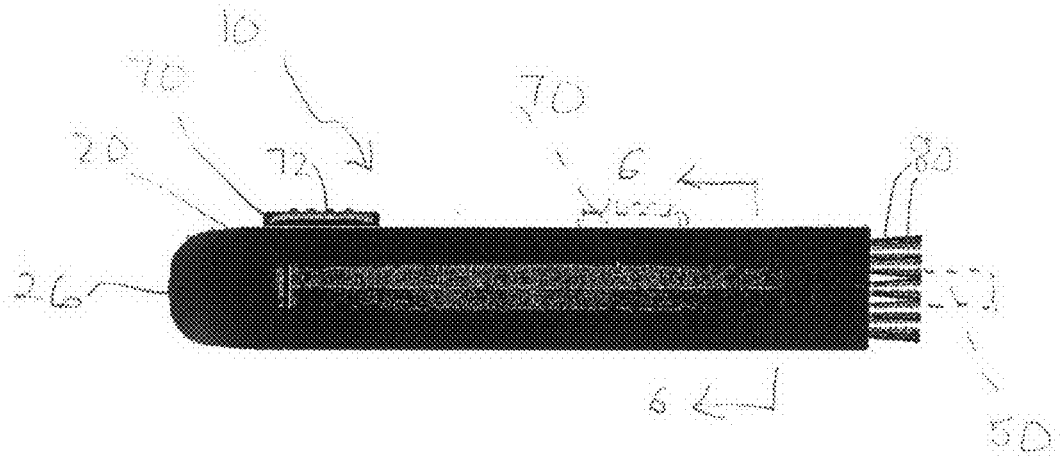
FIG. 1 is a side elevational view, partly in phantom, of a retractable eraser.

With reference to the drawings wherein like numerals represent like parts throughout the several Figures, a retractable eraser is generally designated by the numeral 10. The retractable eraser is a hand-held, thumb actuated eraser. An eraser element is projectable to extend for usage purposes and is subsequently retractable within a protective housing. An extended position is illustrated by broken lines in FIG. 1. The retracted positioned is illustrated in FIGS. 1 and 2.

The housing 20 preferably has a smooth contoured configuration which includes opposed concave portions 22 and 24 and a rounded end connect cap 26 to facilitate manual grasping of the eraser. The retractable eraser is relatively compact and, for one embodiment, has a housing with dimensions of approximately 88 mm×30 mm×15 mm. The housing includes an opening 30 at one end thereof. In one preferred form, the opening is substantially elliptical to substantially conform to the shape of the eraser element as described below.

Figure 2:
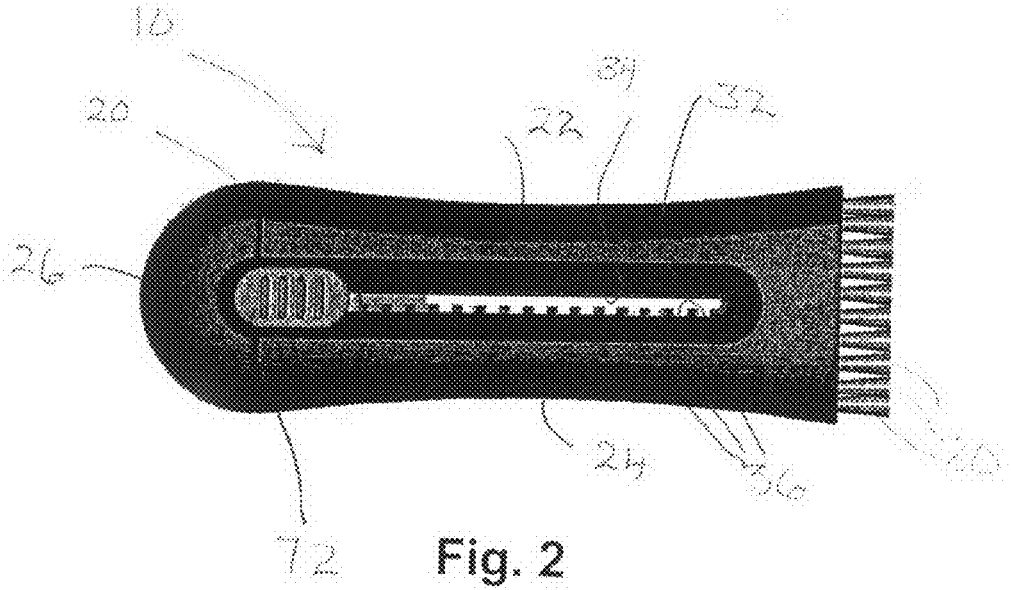
FIG. 2 is a top plan view of the retractable eraser of FIG. 1.
Figure 3:
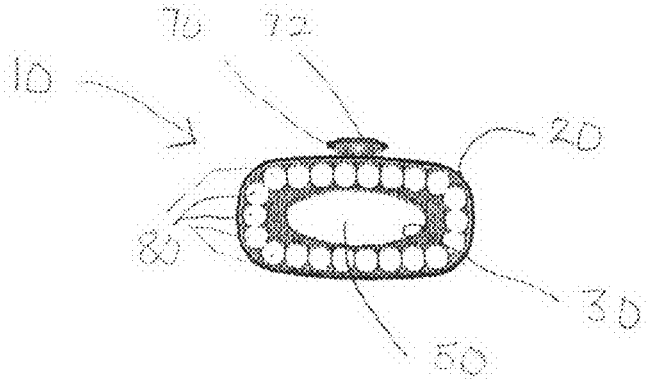
FIG. 3 is a right end view of the retractable eraser of FIG. 1.

With reference to FIG. 2, the top portion of the housing has a recess 32 which extends a substantial longitudinal length of the housing. A longitudinal slot 34 extends into the recess. A plurality of detents 36 are longitudinally spaced and extend transversely from the longitudinal slot.

Figure 4:
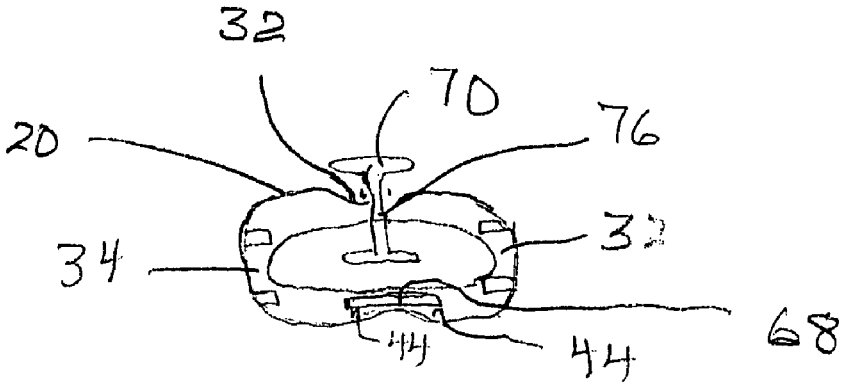
FIG. 4 is a left end view, taken generally opposite that of FIG. 3, with an end cap portion being removed to show the interior portions of the retractable eraser.
Figure 5:
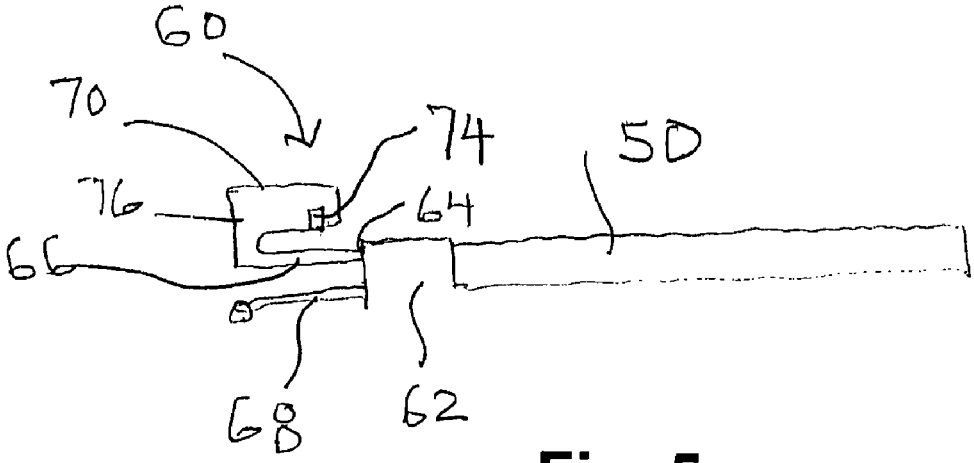
FIG. 5 is a side view of a carrier/eraser subassembly for the retractable eraser of FIG. 1.

With reference to FIGS. 4 and 5, the eraser element 50 is preferably an elongated rubber component having a substantially uniform oval shaped section which may be elliptical or quasi-elliptical and is mounted by a carrier assembly 60. One end of the eraser element is closely received in a mounting receptacle 62 of a carrier 44. A pair of semi-resilient leafs 66 and 68 extend rearwardly. A button 70 integrally extends upwardly via a vertical guide 76 from the upper leaf 66. The button 70 includes an upper thumb actuated surface 72 and a transversely projecting catch 74 which extends from the guide 76 and is spaced from the underside of surface 72. The leaf 66 integrally extends rearwardly and functions as a leaf-type spring.

Figure 6:
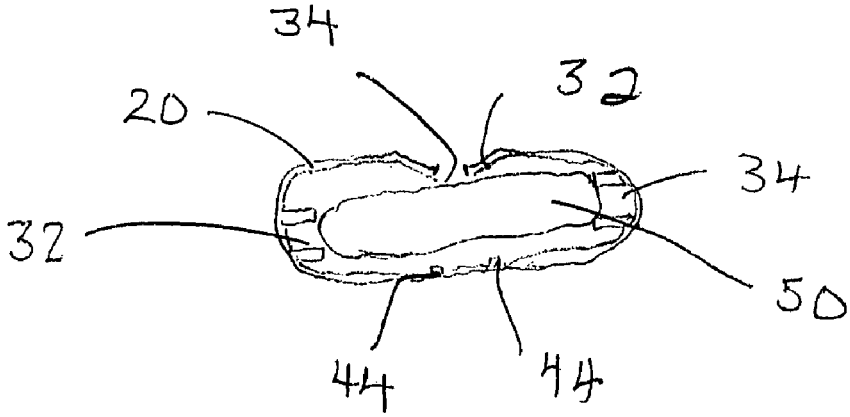
FIG. 6 is a sectional view of the retractable eraser of FIG. 1 taken along line 6-6 thereof.

With additional reference to FIG. 6, a pair of longitudinally extending channels 32 and 34 extends inwardly at the interior of the housing. In addition, a pair of biasing ribs 44 projects upwardly from the floor of the housing. The carrier assembly 60 is slidably received in the housing for longitudinal displacement therealong so that the guide 76 slides along the longitudinal slot 34. When the button 70 is depressed, such as by a thumb actuation, the catch 74 is displaced so that it clears the adjacent detent 34 and the carrier is free to longitudinally slide in the housing. Normally, the leaf 68 biases the carrier upwardly so that the catch is received in a detent to displaceably fix the position of the carrier and hence the position of the eraser element 50 within the housing.

The eraser element 50 and the carrier assembly 60 are configured and dimensioned so that initially, the eraser is fully received in the housing when the carrier is at a rearward position (with the catch engaging a detent). The forward end of the eraser may be projected by depressing the button and sliding the carrier forwardly so that the forward end portion of the eraser element 50 projects through the opening 30 for usage (see broken line portion of FIG. 1).

An array of bristles 80 surrounds the opening 30 and projects forwardly from the housing. It will be appreciated that as the eraser element 50 is positioned for usage, the bristles 80 will surround the eraser element 50, and accordingly, provide an efficient means of removing the eraser remnant materials.

Naturally, as the eraser is used, over time the end portions of the eraser element will be removed until the useful portions of the eraser element would be gradually spent. Consequently, the housed and projected portions of the eraser element will correspond to different positions of the detents as the eraser is used over time. The eraser element may be retracted during periods of non-usage by simply depressing the button and sliding the carrier longitudinally rearwardly.

What is claimed:

1. An eraser assembly comprising:

an elongated housing defining a longitudinal slot with spaced detents and having an opening at one end;

a carrier disposed in said housing and having a button with a catch receivable in said detents and being depressible so that said catch clears the detents to permit longitudinal displacement of said carrier;

an eraser element mounted to said carrier and displaceable with said carrier so that said eraser element in one position is received within said housing and in a second position extends through said opening to project beyond the housing; and bristles projecting at said one end generally longitudinally from said housing.

2. The eraser assembly of claim 1 wherein said eraser element has an elongated shape with a generally oval shaped cross-section.

3. The eraser assembly of claim 1 wherein there is an array of bristle groups generally surrounding said opening.

4. The eraser assembly of claim 1 wherein said carrier has an integral leaf which biases said button so that a catch engages a detent.

5. The eraser assembly of claim 1 wherein said housing defines a pair of guide channels for said eraser element.

6. The eraser assembly of claim 1 wherein said button connects with a vertical guide which is slidable along said slot.

7. An eraser assembly comprising:

an elongated housing defining a longitudinal slot and having an opening at one end;

a carrier disposed in said housing and having a button extending exteriorly of said housing and being movable to permit longitudinal displacement of said carrier, said carrier having a mounting receptacle;

an elongated, oval shaped eraser element mounted to said carrier mounting receptacle and displaceable with said carrier so that said eraser element in one position is received within said housing and in a second position extends through said opening to project beyond the housing; and bristles projecting generally longitudinally from said housing about said opening.

8. The eraser assembly of claim 7 wherein said eraser element has an elongated shape with a generally uniform oval shaped cross-section having a shape generally complementary to said opening.

9. The eraser assembly of claim 8 wherein there is an array of bristle groups generally surrounding said opening.

10. The eraser assembly of claim 7 wherein equidistantly spaced detents extend transversely from said slot and a catch is receivable in said detents and said button is depressible so that said catch clears a detent to permit longitudinal displacement of said carrier and said carrier has an integral leaf which biases said button so that a catch engages a detent.

11. The eraser assembly of claim 7 wherein said housing defines a pair of guide channels for said eraser element.

12. The eraser assembly of claim 7 wherein said button connects with a vertical guide which is slidable along said slot.

* * * * *